US005464730A

United States Patent [19]

Okutsu et al.

[11] Patent Number: 5,464,730

[45] Date of Patent: Nov. 7, 1995

[54] LOW REPLENISHMENT RATE PROCESS OF DEVELOPMENT OF BLACK-AND-WHITE SILVER HALIDE PHOTOGRAPHIC MATERIAL USING A DEVELOPER HAVING A LOW BROMIDE ION CONCENTRATION AND A SPECIFIED PH RANGE

[75] Inventors: Eiichi Okutsu; Takashi Toyoda; Tadashi Ito, all of Kanagawa, Japan

[73] Assignee: Fuji Photo Film Co., Ltd., Kanagawa, Japan

[21] Appl. No.: 232,341

[22] Filed: Apr. 22, 1994

Related U.S. Application Data

[63] Continuation of Ser. No. 45,254, Apr. 13, 1993, abandoned.

[30] Foreign Application Priority Data

Apr. 13, 1992 [JP] Japan ..... 4-492847

[51] Int. Cl.[6] ..... G03C 5/29; G03C 5/31

[52] U.S. Cl. ..... 430/399; 430/434; 430/446; 430/447; 430/489; 430/944; 430/963

[58] Field of Search ..... 430/399, 434, 430/446, 447, 489, 944, 963

[56] References Cited

U.S. PATENT DOCUMENTS

| | | | |
|---|---|---|---|
| 4,046,571 | 9/1977 | Mertz | 430/399 |
| 4,565,774 | 1/1986 | Kajiwara et al. | 430/489 |
| 4,672,025 | 6/1987 | Yamada et al. | 430/489 |
| 4,810,623 | 3/1989 | Kokelenberg et al. | 430/448 |
| 5,066,569 | 11/1991 | Nagashima et al. | 430/963 |
| 5,089,379 | 2/1992 | Yatsuyanagi | 430/434 |
| 5,296,342 | 3/1994 | Roets et al. | 430/447 |

FOREIGN PATENT DOCUMENTS

| | | | |
|---|---|---|---|
| 62-50828 | 3/1987 | Japan | 430/434 |
| 3-168739 | 7/1991 | Japan | 430/944 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

Disclosed is a method of developing a transmission black-and-white silver halide photographic material with an automatic processor, in which a developer having a bromide ion concentration of 0.01 mol/liter or less and having a pH value of 9.8 or less is used with replenishment of the developer being in an amount of about 200 ml or less per $m^2$ of the material being processed. Though the amount of the replenisher to the developer used is small in the method, the photographic properties of the processed material are stable and the processed material is fogged little.

12 Claims, No Drawings

LOW REPLENISHMENT RATE PROCESS OF DEVELOPMENT OF BLACK-AND-WHITE SILVER HALIDE PHOTOGRAPHIC MATERIAL USING A DEVELOPER HAVING A LOW BROMIDE ION CONCENTRATION AND A SPECIFIED PH RANGE

This is a continuation of application Ser. No. 08/045,254 filed Apr. 13, 1993 now abandoned.

FIELD OF THE INVENTION

The present invention relates to a process of development of a black-and-white silver halide photographic material, using an automatic processor, in which the amount of the replenisher to the developer per the unit area of the material being processed is reduced, but stable photographic properties of the processed material are still obtained.

BACKGROUND OF THE INVENTION

A black-and-white silver halide photographic material is generally processed, after having been exposed, by a process comprising development, fixation, washing and drying. Recently, the process is mostly carried out using automatic processors. In general, the development of the material with such an automatic processor is effected with replenishing a predetermined amount of a developer in proportion to the area of the material being processed. It has heretofore been desired to obtain stable photographic properties of the material as developed and processed in this manner. It has also been desired to reduce the amount of the replenisher per the unit area of the material being processed, while still obtaining stable photographic properties of the processed material. Heretofore, when a so-called sheet-like photographic material, such as, an X-ray photographic material or graphic art photographic material is processed, it is the general practice to replenish a replenisher to the developer in the ratio of an amount of 250 ml or more, especially 330 ml or more, to one $m^2$ of the material being processed.

However, since the waste from photographic development has a high chemical oxygen demand (C.O.D.) or has a high biological oxygen demand (B.O.D.), chemical or biological treatment is normally applied to the waste, so as to make it non-toxic prior to draining the waste. Since such treatment of the photographic waste material is a great economic burden on the users, a development method requiring addition of a reduced amount of replenisher to the developer is desired.

SUMMARY OF THE INVENTION

The object of the present invention is to provide a method of processing a transmission black-and-white silver halide photographic material with an automatic processor, in which the amount of the replenisher added to the developer per the unit area of the material being processed is reduced. In accordance with the method of the invention, stable photographic properties of the processed material are still obtained, even though the amount of the replenisher added during development is reduced.

The foregoing object of this invention has been attained by a process of developing a transmission black-and-white silver halide photographic material (which provides an image being observed utilizing transmitted light) using an automatic processor, in which a developer is employed which has a bromide ion concentration of 0.01 mol/liter or less, and a pH value of 9.8 or less, and which is replenished in an amount of 200 ml or less per $m^2$ of the material being processed.

As one preferred embodiment of the invention, the developer contains a benzotriazole derivative or a nitroindazole compound.

If the bromide ion concentration in the developer is elevated, then the sensitivity of the photographic material being processed is unfavorably reduced. The bromide ion concentration in the developer is therefore preferably 0.01 mol/liter or less. The developer may contain substantially no bromide ion.

Furthermore, the foregoing object of this invention has been preferably attained by the above-described process using the photographic material having a silver halide emulsion layer spectrally-sensitized to be sensitive to rays of 600 nm or more on a transmission support having a thickness of 150 μm or more, and the silver halide grains in said emulsion layer a) have a mean grain size of from 0.1 to 0.4 μm, b) contain those having a ratio of (100) plane to (111) plane of 5 or more in an amount of 50% by weight or more based on the entire silver halide grains, c) have a silver chloride content of 90 mol % or more, and d) have a composition selected from the group consisting of silver chlorobromide, silver chloroiodide and silver chloroiodobromide, or silver chloride.

DETAILED DESCRIPTION OF THE INVENTION

The silver halide to be used in the photographic emulsion layer of the photographic material to be processed by the method of the present invention is a high silver chloride emulsion of a silver chlorobromide, silver iodochloride, silver iodochlorobromide or silver chloride having a mean silver chloride content of 90 mol % or more, in which the silver iodide content is preferably not more than 1 mol %. Especially preferred is a silver chlorobromide or silver chloride having a mean silver chloride content of 96 mol % or more.

The silver halide grains to be included in the high silver chloride emulsion for use in the present invention are desired each to have therein a localized silver bromide layer having a relatively high silver bromide content, as compared with the base halide composition of the grain.

As preferred embodiments of such a localized structure of the silver halide grain, the localized phase is on the surface of the grain or in the inside near the surface thereof. Especially preferred are grains in which the edges or corners of the crystal surface of the grain have the localized phase, or the localized phase is on the crystal surface of the same as small hills thereon. The halide composition in the localized phase may be such that the silver bromide content in the phase is from 10 mol % to 95 mol %; especially preferred is a content of from 15 mol % to 90 mol %; even more preferable is a content of from 20 mol % to 60 mol %; most preferable is a content of from 30 mol % to 60 mol %.

The remaining silver halide content in the localized phase comprises silver halide, preferably containing a small amount of silver iodide. However, it is not preferred that the silver iodide content therein is more than 1 mol % to the total silver halide content, as mentioned above.

The localized phase is desired to be from 0.03 mol % to 35 mol %, and more preferably from 0.1 mol % to 25 mol %, of the whole silver halide content constituting all of the silver halide grains of the emulsion.

The localized phase does not need to be composed of a single halide composition. The grain may have two or more localized phases each having a definitely different silver bromide content, or alternatively, it may be such that the interface between the localized phase and the other phase in the grain has a continuously varying halide composition.

For forming the preceding silver bromide localized phase, a water-soluble silver salt and a water-soluble halide containing a water-soluble bromide are applied to an emulsion containing already formed silver chloride or high silver chloride grains by a double jet method and are reacted with each other so that the intended localized phase is precipitated on the grain; or alternatively, a part of already formed silver chloride or high silver chloride grains are converted to a silver bromide-rich phase by a so-called halogen conversion method; or further alternatively, to already formed silver chloride or high silver chloride grains are added fine silver bromide or high silver bromide grains having a smaller grain size than the silver chloride or high silver chloride grains or other hardly soluble silver salts so that the intended localized phase is formed by recrystallization on the surface of the silver chloride or high silver chloride grains.

For the methods of forming the silver bromide localized phase, for example, reference may be made to the description of European Patent Application Laid-Open No. 0,273,430A2.

The silver bromide content in the localized phase may be analyzed by X-ray diffraction, for example, by the method described in *Lecture of New Experimental Chemistry*, No. 6, Structural Analysis, edited by the Chemical Society of Japan, published by Maruzen Publishing Co. or by an XPS method, as described, for example, in *Surface Analysis—IMA*, Application of Auger Electron and Photoelectron Spectrography, published by Kodansha Publishing Co. In addition, the silver bromide localized phase may also be detected by electromicroscopic observation or by the method described in the preceding European Patent Application Laid-Open No. 0,273,430A2.

Of the preceding methods, the method of forming a high silver bromide layer which is especially useful in the present invention is such that silver bromide and/or silver chlorobromide are/is formed on the surface of the grains of a high silver chloride emulsion during chemical ripening of the grains. The method is especially preferred, since the resulting emulsion is desired to have high sensitivity with hardly any fogging.

It is preferred to incorporate other metal ions (such as metal ions of Group VIII of the Periodic Table, transition metal ions of Group II lead ion of Group IV, metal ions and copper ion of Group I) or complex ions of such metals other than, silver ion, into the silver halide grains for use in the present invention so as to more effectively attain the effect of the present invention under various conditions. Such metal ions or complex ions of such metals may be incorporated wholly into all the grains, or partly into the preceding silver halide localized phase of the grains, or into the other phases of them.

Of the preceding metal ions or their complex ions, especially preferred are those selected from iridium ion, palladium ion, rhodium ion, zinc ion, iron ion, platinum ion, gold ion and copper ion. In may cases, such metal ions, or their complex ions, are preferably incorporated into the grains in combination, rather than singly, to attain the desired photographic properties. In particular, especially preferred is that the kinds and the amounts of the ions to be added are varied between the localized phase and the other parts of the grain. Especially preferably, iridium ion or rhodium ion is incorporated into the localized phase of the grain.

For incorporating metal ion(s) and/or complex ion(s) into the localized phase and/or other parts of the silver halide grain, the ion(s) may be directly added to the reactor before or during formation of the silver halide grains or after their formation and during their physical ripening; or it(they) may previously be added to the solution of water-soluble halide salt(s) or to the solution of a water-soluble silver salt to be reacted. Where the localized phase is to be formed by adding fine silver bromide or high silver chloride grains to host grains, metal ion(s) and/or complex ion(s) are previously incorporated into the fine silver bromide or high silver chloride grains by the same method mentioned above, and the resulting fine grains may be added to a silver chloride or high silver chloride emulsion. As the case may be, bromides of metal ions which are relatively hardly soluble, except silver salts, such as those mentioned above, may be added to the silver halide emulsion in the form of a solid or powder of the bromides, so as to incorporate the metal ions into the silver halide grains and at the same time, forming the localized phase thereon.

The silver halide emulsion of the present invention preferably contains silver halide grains each having a ratio by area of (100) plane/(111) plane of being 5 or more, preferably 10 or more, in an amount of 50% by weight or more, more preferably 60% by weight or more, and especially preferably 80% by weight or more, based on the entire silver halide grains in the emulsion.

The size of the silver halide grains for use in the present invention is not larger than 0.4 μm, but is preferably 0.35 μm or less, and more preferably 0.3 μm or less. The lower limit is preferably 0.1 μm.

This is because smaller grains have greater covering power, so that the silver/binder ratio may advantageously be reduced.

The grain size distribution of the silver halide grains of the present invention may be either broad or narrow. A so-called monodispersed emulsion is preferred in view of the fact that it provides desirable photographic characteristics, such as, latent image stability and pressure resistance, and processing stability, such as low dependence on the pH of the developer. Preferably, the value S/d to be obtained by dividing the standard deviation (S) of the distribution of the diameters of the silver halide grains (as the circle-corresponding diameters of the projected areas of the grains) by the mean diameter (d) is 20% or less, and more preferably 15% or less.

The silver chloride, silver chlorobromide or silver chloroiodobromide emulsion for use in the present invention may be prepared in accordance with the methods described, for example, in P. Glafkides, *Chimie et Physique Photographiques* (published by Paul Montel, 1967), G. F. Duffin, *Photographic Emulsion Chemistry* (published by Focal Press, 1966) and V. L. Zelikman, *Making and Coating Photographic Emulsion* (published by Focal Press, 1964). Briefly, any of the acid methods, neutral methods and ammonia methods may be employed. Of them, an acid method and a neutral method are especially preferably employed in the present invention so as to reduce fogging of the photographic material. If desired, a so-called single jet method or double jet method or combination of them may be employed for obtaining a silver halide emulsion by reacting a soluble silver salt and soluble halide(s). A so-called reversed mixing method of forming silver halide grains in the presence of excess silver ions may also be employed. For obtaining an emulsion of monodispersed silver halide grains, which is preferably used in the present invention, a double jet method is preferred. As one type of system of the double jet kind of method, a so-called controlled double jet method is especially preferably employed. In this method the silver ion concentration in the liquid phase of forming silver halide grains is kept constant. In accordance with this method, a silver halide emulsion containing silver halide grains of regular crystals and having a narrow grain size distribution is obtained, and such an emulsion is advantageously used in the present invention.

In the step of forming the silver halide grains or in the step of physical ripening of them, a cadmium salt, a zinc salt, a lead salt, a thallium salt, or the preceding iridium salt or iridium complex salt, rhodium salt or rhodium complex salt, or iron salt or iron complex salt may be added to the grains.

During or after formation of the grains, a silver halide solvent (for example, known ammonia or thiocyanates, or thioethers or thione compounds described in U.S. Pat. No. 3,271,157, JP-A-51-12360, JP-A-53-82408, JP-A-53-144319, JP-A-54-100717 and JP-A-54-155828) may be added to the grains. Where addition of such a silver halide solvent is combined with the preceding methods, a silver halide emulsion can be obtained which contains silver halide grains of regular crystals and having a narrow grain size distribution; such an emulsion is preferably used in the present invention.

For removing soluble salts from the physical-ripened emulsion, useful methods include noodle washing, flocculation or ultrafiltration.

The emulsion for use in the present invention may be chemical-sensitized by sulfur sensitization, selenium sensitization, reduction sensitization and/or noble metal sensitization. Specifically, methods useful for such chemical-sensitization include sulfur sensitization using an active gelatin or a sulfur-containing compound capable of reacting with silver ion (for example, thiosulfates, thiourea compounds, mercapto compounds, rhodanine compounds), reduction sensitization using a reducing compound (for example, stannous salts, amines, hydrazine derivatives, formamidinesulfinic acid, silane compounds), noble metal sensitization using a metal compound (for example, the preceding gold complexes, salts or complex salts of metals of the Group VIII of the Periodic Table, such as, platinum, iridium, palladium, rhodium or iron), or combinations of them. To the emulsion of the present invention, there is preferably applied sulfur sensitization or selenium sensitization, which is more preferably combined with gold sensitization. In such chemical sensitization of the emulsion of the present invention, addition of a hydroxyazaindene compound or nucleic acid is preferred so as to control the sensitivity and gradation of the photographic material incorporating such an emulsion.

Sensitizing dyes for rays of 600 nm or more may be employed in the present invention. Preferred are those described in JP-A-3-11336, JP-A-64-40939, and Japanese Patent Application Laid-Open Nos. 2-266934, 3-121798, 3-228741, 3-266959 and 3-311498. Sensitizing dyes for rays of 600 nm to 950 nm are preferred in the present invention.

Such sensitizing dyes may be used singly, but are preferably used in combinations. Combinations of such sensitizing dyes are often employed for supersensitization. Along with sensitizing dyes, dyes not having a spectral sensitizing action of themselves or substances which do not substantially absorb visible rays, but do display supersensitization, may be incorporated into the emulsion.

Useful sensitizing dyes, combinations of dyes displaying supersensitization, and substances displaying supersensitization are described in Research Disclosure, Vol. 176, No. 17643 (issued in December 1978), page 23, Item IV-J, as well as in the preceding JP-B-49-25500 and JP-B-43-4933 and JP-A-59-19032 and JP-A-59-192242.

It is desired to select the optimum amount of the sensitizing dye for rays of 600 nm or more for incorporation in the emulsion of the present invention, depending upon the grain size and the halogen composition of the silver halide grains in the emulsion, the method and degree of chemical sensitization of the emulsion, the relation between the layer in which the dye is incorporated and the silver halide emulsion, and the kind of the anti-foggant to be used in the emulsion. The testing methods for such selections are well known by those skilled in the art. In general, the amount of the dye is preferably from $10^{-7}$ to $1\times10^{-2}$ mol, and especially preferably is an amount from $10^{-6}$ to $5\times10^{-3}$ mol, per mol of silver halide in the emulsion.

The photographic material to be processed by the method of the present invention may contain various compounds for the purpose of preventing fog of the material during manufacture, storage and photographic processing, or for stabilizing the photographic properties of the material during the same. Usable for these purposes are various compounds known as an anti-foggants or stabilizers, for example, azoles such as benzothiazolium salts, nitroindazoles, chlorobenzimidazoles, bromobenzimidazoles, mercaptotetrazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds, such as, oxazolinethione; azaindene compounds, such as, triazaindenes, tetrazaindenes (especially, 4-hydroxysubstituted (1,3,3a,7)tetrazaindenes) and pentazaindenes; benzenethiosulfonic acids, benzenesulfinic acids and benzenesulfonic acid amides. Of the above, preferred materials are benzotriazoles (e.g., 5-methyl-benzotriazole) and nitroindazoles (e.g., 5-nitroindazole). Such compounds may be incorporated into the processing solutions to be used in the method of the present invention. Compounds capable of releasing an inhibitor during development, such as those described in JP-A-62-30243, may also be incorporated into the photographic material or into the processing solutions, as a stabilizer.

The photographic material to be processed by the method of the present invention may contain a developing agent, such as, hydroquinone derivatives or phenidone derivatives, for various purposes as a stabilizer or an accelerator.

The photographic material to be processed by the method of the present invention may contain an inorganic or organic hardening agent in the photographic emulsion layer or in other hydrophilic colloid layers. For instance, usable as hardening agents are chromium salts (e.g., chromium alum, chromium acetate), aldehydes (e.g., formaldehyde, glutaraldehyde), N-methylol compounds (e.g., dimethylol urea), dioxane derivatives, active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogenic acids (e.g., mucochloric acid) and the like. They may be employed singly or in combinations.

The black-and-white photographic material to be processed by the method of the present invention may contain a water-soluble dye in the hydrophilic colloid layer as a filter dye, or for other various purposes of anti-irradiation, or the like. Such dyes include, for example, oxonole dyes, hemioxonole dyes, styryl dyes, merocyanine dyes, cyanine dyes and azo dyes. Preferred among then are oxonole dyes, hemioxonole dyes, and merocyanine dyes.

The support of the photographic material of the present invention have a thickness of 150 μm or more, preferably from 150 to 250 μm. This is critical in view of the point of handling the material for viewing it on a medical light table. The material of the support is preferably a polyethylene terephthalate film, which is more preferably colored blue. A formed image is observed utilizing transmitted light.

The surface of the support is preferably treated by corona discharge, glow discharge, or ultraviolet irradiation, for the purpose of elevating the adhesiveness of the support to hydrophilic colloid layers to be coated thereover. If desired, a subbing layer made of a styrene-butadiene latex or vinylidene chloride latex may be provided on the support, and it may be coated with a gelatin layer.

If desired, a subbing layer formed from an organic solvent containing a polyethylene swelling agent and a gelatin may be provided on the support.

The subbing layer is preferably surface-treated so as to further elevate the adhesiveness of the layer to hydrophilic colloid layers to be coated thereover.

The total gelatin amount on the silver halide emulsion layer side of the support is preferably 3.5 g/m$^2$ or less, more preferably 3.3 g/m$^2$ or less, and most preferably 3.0 g/m$^2$ or less. The lower limit is preferably 1.5 g/m$^2$.

The silver amount in the silver halide emulsion to be coated on one surface of the support is 2.6 g/m$^2$ or less, preferably 2.3 g/m$^2$ or less, and more preferably 2.0 g/m$^2$ or less. The lower limit is preferably 1.0 g/m$^2$.

The weight ratio of silver to gelatin in the coated silver halide emulsion layer is also an important factor in view of the rapid processability of the material. Where the ratio of silver to gelatin in the coated silver halide emulsion layer is highly elevated, the coated layer would peel off from the support (pick-off of emulsion) due to the projections of the roller, when the material is processed with an automatic processor, so that the image formed could only be viewed with difficultly. In view of that fact, the weight ratio of silver to gelatin in the coated silver halide emulsion layer is preferably 1.4 or less, more preferably 1.2 or less, an most preferably 1.1 or less.

As additives to be employed in the photographic material of the present invention, reference may be made to the descriptions contained in the following listed References:

| | References |
|---|---|
| 1) Chemical Sensitization | JP-A-2-68539, page 10, from right top column, line 13 to left top column, line 16; Japanese Patent Application No. 3-105035 |
| 2) Antifoggant, Stabilizer | JP-A-2-68539, from page 10, left bottom column, line 17 to page 11, left top column, line 7, from page 3, left bottom column, line 2 to page 4, left bottom column. |
| 3) Color Tone Improving Agent | JP-A-62-276539, from page 2, left bottom column, line 7 to page 10, left bottom column, line 20; JP-A 3-94249, from page 6, left bottom column, line 15 to page 11, right top column, line 19 |
| 4) Surfactant, Antistatic Agent | JP-A-2-68539, from page 11, left top column, line 14 to page 12, left top column, line 9 |
| 5) Mat Agent, Lubricant, Plasticizer | JP-A-2-68539, page 12, from left top column line 10 to right top column, line 10, page 14, from left bottom column, line 10 to right bottom column, line 1 |
| 6) Hydrophilic Colloid | JP-A-2-68539, page 12, from right top column, line 11 to left bottom column, line 16 |
| 7) Hardening Agent | JP-A-68539, from page 12, left bottom column, line 17 to page 13, right top column, line 6 |
| 8) Polyhydroxybenzenes | JP-A-3-39948, from page 11, left top column to page 12, left bottom column; EP 452772A |
| 9) Layer Constitution | JP-A-3-198041 |

The developing agent preferred for use in the developer of the present invention is a dihydroxybenzene developing agent. The agent includes, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of the foregoing, especially preferred is hydroquinone. The content of the developing agent in the developer is generally from 0.05 mol/liter to 0.8 mol/liter.

Combinations of the preceding dihydroxybenzene developing agent and 1-phenyl-3-pyrazolidones or p-aminophenols are preferably employed in carrying out the present invention.

As usable 1-phenyl-3-pyrazolidones, there may be mentioned 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, and 1-phenyl-5-methyl-3-pyrazolidone.

As usable p-aminophenols, there may be mentioned N-methyl-p-aminophenol, N-(β-hydroxyethyl)-p-aminophenol, N-(4-hydroxyphenyl)glycine, 2-methyl-p-aminophenol, and p-benzylaminophenol. Of these, N-methyl-p-aminophenol is preferred.

Where the dihydroxybenzene developing agent is to be used in combination with an auxiliary developing agent, for example, 1-phenyl-3-pyrazolidones or p-aminophenols, it is preferred that the ratio of the former is from 0.05 mol/liter to 0.5 mol/liter to the developer, and that the ratio of the latter is from 0.001 to 0.06 mol/liter, and especially preferably from 0.003 to 0.06 mol/liter to the same.

The developer for use in the present invention may contain a sulfite, such as sodium sulfite, potassium sulfite, lithium sulfite, ammonium sulfite, sodium bisulfite, potassium metabisulfite or formaldehyde-sodium bisulfite. The content of the sulfite in the developer may be 0.10 mol/liter or more, especially preferably 0.20 mol/liter or more. The upper limit of the amount of sulfite in the developer is preferably up to 2.5 mol/liter, and especially preferably up to 1.2 mol/liter.

The developer may also contain an amino compound for promotion of the developability. For example, amino compounds described in JP-A-56-106244 and JP-A-61-267759 and JP-A-2-208652 may be used.

The pH value of the developer is 9.8 or less, preferably 8.5 to 9.8. For defining the pH value of the developer, an alkali agent may be incorporated into the developer. In general, a water-soluble inorganic alkali metal (such as sodium hydroxide, sodium carbonate) may be employed.

The developer preferably contains a benzotriazole derivative and/or a nitroindazole compound. Examples of the benzotriazole derivative include 5-methylbenzotriazole, 5-bromobenzotriazole, 5-chlorobenzotriazole, 5-butylbenzotriazole and benzotriazole. Of them, especially preferred is 5-methylbenzotriazole. Examples of the nitroindazole compound include 5-nitroindazole, 6-nitroindazole, 4-nitroindazole, 7-nitroindazole and 3-cyano-5-nitroindazole. Of these, especially preferred is 5-nitroindazole. Where such a 5-nitroindazole compound is incorporated into the developer, it is previously dissolved in a part separately from the part containing the dihydroxybenzene developing agent and the sulfite preservative, and the two parts are then generally mixed along with water before use. The part in which the 5-nitroindazole compound is dissolved is advantageously alkaline, since the alkaline part is colored yellow and is conveniently handled. The concentration of the benzotriazole derivative or the nitroindazole compound is preferably from $1\times10^{-4}$ to $2\times10^{-2}$ M/liter.

The replenisher to the developer to be used in the present invention may contain a pH buffer such as boric acid, borax, sodium secondary phosphate, potassium secondary phosphate, sodium primary phosphate or potassium primary phosphate. In addition, pH buffers described in JP-A-60-93433 are also employable. The replenisher may further contain a development inhibitor, such as, potassium bromide or potassium iodide, and an organic solvent, such as, dimethylformamide, methyl cellosolve, hexylene glycol, ethanol and methanol.

If desired, the developer may further contain a color toning agent, a surfactant, a water softener and a hardening agent.

The developer may contain a chelating agent, which is preferably one having a chelate stability constant to ferric ion ($Fe^{3+}$) of 8 or more.

As specific examples of chelating agents having a chelate stability constant to ferric ion ($Fe^{3+}$) of 8 or more, there may be mentioned, for example, ethylenediamine-diorthohydroxyphenylacetic acid, diaminopropanetetraacetic acid, nitrilo-triacetic acid, hydroxyethylethylenediamine-triacetic acid, dihydroxyethylglycine, ethylenediamine-diacetic acid, ethylenediamine-dipropionic acid, imino-diacetic acid, diethylenetriamine-pentaacetic acid, hydroxyethylimino-diacetic acid, 1,3-diaminopropanoltetraacetic acid, triethylenetetramine-hexaacetic acid, transcyclohexanediamine-tetraacetic acid, ethylenediamine-tetraacetic acid, glycoletherdiamine-tetraacetic acid, ethylenediamine-tetrakismethylenephosphonic acid, diethylenetriamine-pentamethylenephosphonic acid, nitrilotrimethylenephosphonic acid, 1-hydroxyethylidene- 1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,5-disulfonic acid, sodium pyrophosphate, sodium tetrapolyphosphate, and sodium hexametaphosphate. Of these, especially preferred are diethylenetriamine-pentaacetic acid, triethylenetetramine-hexaacetic acid, 1,3-diaminopropanol-tetraacetic acid, glycolether-diaminetetraacetic acid, hydroxyethylethylenediamine-triacetic acid, 2-phosphonobutane-1,2,4-tricarboxylic acid, 1,1-diphosphonoethane-2-carboxylic acid, nitrilotrimethylenephosphonic acid, ethylenediamine-tetraphosphonic acid, diethylenetriamine-pentaphosphonic acid, 1-hydroxypropylidene-1,1-diphosphonic acid, 1-aminoethylidene-1,1-diphosphonic acid, 1-hydroxyethylidene-1,1-diphosphonic acid, and their salts.

The developer for use in the present invention may contain the compounds described in JP-B-62-4702 and JP-B- 62-4703, JP-A-1-200249 and Japanese Patent Application Nos. 3-94955, 3-112275 and 3-233718, for the purpose of preventing silver stains in the processed photographic material.

In addition, the developer may also contain, as a hardening agent, dialdehyde compounds or dialdehydebisulfite adducts. As specific examples, there may be mentioned glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, α-n-butoxyglutaraldehyde, α,α-dimethoxysuccindialdehyde, β-isopropylsuccindiaidehyde, α,α-diethylsuccindialdehyde, butylmaleindialdehyde, and their bisulfite adducts. Such a dialdehyde compound is added to the developer to such a degree that the sensitivity of the photographic layer to be processed is not retarded, and the drying time of drying the processed material is not too prolonged. For instance, the content of the compound in the developer may be from 1 to 50 g, and preferably from 3 to 10 g, per liter of developer. Above all, glutaraldehyde or its bisulfite adduct is most generally employed.

As a matter of course, where a dialdehydebisulfite adduct is incorporated into the developer as a hardening agent, the bisulfite moiety in the adduct is calculated as the content of the sulfite in the developer.

In addition, other additives, such as, those described in L. F. Mason, Photographic Processing Chemistry (published by Focal Press, 1966), pp. 226 to 229, U.S. Pat. Nos. 2,193,015 and 2,692,364 and JP-A-48- 64933 may also be added to the developer.

In accordance with the method of the present invention, the preceding developer is replenished in an amount of 200 ml or less, and especially preferably from 50 to 200 ml, per $m^2$ of the photographic material being processed, during development of the material.

The original developer to be charged in the development tank of the automatic processor to be employed for processing the photographic material, in accordance with the method of the present invention, may be the same one as above or may also have a composition partially different from that of the preceding developer.

The fixer to be employed in the method of the present invention is an aqueous solution containing a thiosulfate, and it has pH of 3.8 or more, and preferably from 4.2 to 6.0.

As a fixing agent to be used in the fixer, there may be mentioned, for example, sodium thiosulfate and ammonium thiosulfate. The amount of the fixing agent to be in the fixer may be varied suitably. In general, it may be approximately from 0.1 to 3 mol/liter.

The fixer may contain a water-soluble aluminium salt which acts as a hardening agent. Such salts include, for example, aluminium chloride, aluminium sulfate and potassium alum.

The fixer may contain tartaric acid, citric acid, gluconic acid or their derivatives, singly or in combinations of two or more. These compounds are added into the fixer effectively in an amount of 0.005 mol/liter or more, and especially effectively in an amount from 0.01 mol/liter to 0.03 mol/liter.

The fixer may also contain, if desired, a preservative (such as sulfites, bisulfites), a pH buffer (such as acetic acid, boric acid), a pH regulating agent (such as sulfuric acid), a water-softening chelating agent, and compounds as described in JP-A-62-78551.

In accordance with the preceding method of the present invention, after being developed and fixed, photographic materials are then rinsed in water or treated with a stabilizer, and thereafter are dried.

Automatic processors of various types, for example, roller-conveying or belt-conveying types may be employed in carrying out the method of the present invention. Preferably employed is a roller-conveying type automatic processor. Using an automatic processor having a development tank having a small opening ratio, such as those described in JP-A-1-166440 and JP-A-l-193853, aerial oxidation or evaporation of the developer may be retarded, so that operation of the process in a manner that is stable to the processing environment may be effected and the amount of the replenisher added to the system may be even further reduced.

As a method of reducing the amount of the replenisher to the rinsing tank, a multi-stage countercurrent system (for example, comprising two or more stages) has been known in the past. Where the multi-stage countercurrent system is applied to the method of the present invention, the fixed photographic material may be conveyed successively to the clearer direction, or that is, successively to the direction of the processing tank which is less stained by the fixer used. As a result, more effective rinsing may be effected by the system.

In the preceding water-saving process or pipeless process, a microbicidal means is preferably applied to the rinsing water or to the stabilizer.

As such a microbicidal means, employable are, for example, ultraviolet irradiation, as described in JP-A-60-263939, use of a magnetic field, as described in JP-A-60-263940, use of an ion-exchange resin to form pure water, as described in JP-A-61-131632, and use of a microbicide, as described in JP-A-61-115154, JP-A-62-153952, JP-A-62-220951 and JP-A-62-209532.

In addition, also employable are bactericides, fungicides and surfactants as described in L. F. West, Water Quality Criteria, *Photo. Sci. & Eng.*, Vol. 9, No. 6 (1965); N. W. Beach, Microbiological Growths in Motion-Picture Processing, *SMPTE Journal*, Vol. 85 (1976); R. D. Deegan, Photo Processing Wash Water Biocides, *J. Imaging Tech.*, 10, No. 6 (1984); and JP-A-57-8542, JP-A-57-58143, JP-A-58-105145, JP-A-57-132146, JP-A-58-18631, JP-A-57- 97530 and JP-A-57-157244.

In addition, there may also be added to the rinsing bath or stabilizing bath as a microbicide isothiazoline compounds described in R. T. Kreiman, J. Image. Tech., 10, (6), p. 242 (1984); isothiazoline compounds as described in Research Disclosure, Vol. 205, No. 20526 (May·1981); isothiazoline compounds as described in ibid., Vol. 228, No. 22845 (April 1983); and compounds as described in JP-A-62-209532.

Moreover, the bath may also contain microbicidal compounds as described in H. Horiguchi, *Bactericidal and Fungicidal Chemistry* (published by Sankyo Publishing Co. in 1972 ) and *Handbook for Bactericidal and Fungicidal Technology* (edited by Japan Bactericidal Fungicidal Society and published by Hakuho-do in 1986).

Where the rinsing of the photographic material, as processed by the method of the present invention, is effected by a small amount of rinsing water, squeeze roller rinsing tanks, as described in JP-A-63-18350, are preferably employed. A rinsing step of the type described in JP-A-63-143548 is also preferably employed.

A part or all of the overflow from the rinsing or stabilizing tank to be generated by replenishment of a rinsing replenisher, to which the preceding microbicidal means has been applied in the tank, may be circulated back to the fixing solution in the previous bath as described in JP-A-60-235133.

The "development step time" as referred to herein indicates the time needed from the start of dipping the top of the photographic material to be processed in the developer tank of an automatic processor to the start of dipping it in the next fixer tank; the "fixation time" indicates the time needed from the start of dipping the material in the fixer tank to the start of dipping it in the next rinsing tank (or stabilizer tank); and the "rinsing time" indicates the time needed for dipping the fixed material in the rinsing tank.

The "drying time" as referred to herein indicates the time while the processed photographic material is in a drying zone of an automatic processor with hot air of from 35° C. to 100° C., and preferably from 40° C. to 80° C. being blown into the drying zone.

In accordance with the method of the present invention, the development time may be from 5 seconds to one minute, and preferably from 8 seconds to 30 seconds; the development temperature is preferably from 18° C. to 50° C., and more preferably from 20° C. to 40° C.

In accordance with the method of the present invention, the fixing temperature and the fixing time are preferably approximately from 18° C. to 50° C. and from 5 seconds to one minutes, and more preferably from 20° C. to 40° C. and from 6 seconds to 30 seconds, respectively. Within the defined ranges, sufficient fixation may be completed and the incorporated sensitizing dyes may well be dissolved out to such a degree that they do not color the processed photographic material.

The temperature and the time for the rinsing step (or stabilizing step) are preferably from 0° to 50° C. and from 6 seconds to one minute, and more preferably from 15° C. to 40° C. and from 6 seconds to 30 seconds, respectively.

In accordance with the method of the present invention, the developed, fixed and rinsed (or stabilized) photographic material is squeezed with squeeze rollers to remove the rinsing water remaining in the material and then dried. The drying is effected at approximately from 40° C. to 100° C., and the drying time may well be varied depending upon the environmental conditions. In general, the drying time may well be approximately from 5 seconds to one minute, and especially preferably approximately from 5 seconds to 30 seconds, when the drying temperature is from 40° to 80° C.

Where a photographic material is processed by the method of the present invention of a dry-to-dry system for processing of 100 seconds or less, it is more preferred to apply rubber rollers to the outlet of the developer tank, as so described in JP-A-63-151943, or to elevate the jetting flow rate for stirring the developer in the developer tank to 10 m/min or more, as so described in JP-A-63- 151944, or to apply stronger agitation, at least to the developer during operation, than to the developer on standby alert, as so described in JP-A-63-264758. For rapid processing, the constitution of the rollers in the fixer tank is preferably in the form of a pair of facing rollers so as to elevate the fixing rate. By employing such facing rollers, the number of necessary rollers may be reduced a smaller and the size of processing tank may be used; the automatic processor to be employed will also thereby be correspondingly reduced.

The present invention will be explained in more detail by way of the following examples, which, however, are not intended to restrict the scope of the present invention.

EXAMPLE 1

1. Preparation of Silver Halide Emulsion A 32 g of gelatin was added to 900 ml of distilled water and dissolved therein at 40° C., and the pH of the resulting solution was adjusted to 3.8 with sulfuric acid. 3.3 g of sodium chloride was added thereto. A solution of 32 g of silver nitrate in 200 ml of distilled water and a solution of 11 g of sodium chloride and 0.02 mg of $K_2IrCl_6$ in 200 ml of distilled water were added to and blended with the previous solution under the condition of 40° C. over a period of 2 minutes. A solution of 64 g of silver nitrate in 280 ml of distilled water and a solution of 21.6 g of sodium chloride in 275 ml of distilled water were added to and blended with the previous combined solution under the condition of 40° C. over a period of 5 minutes. Next, a solution of 64 g of silver nitrate in 280 ml of distilled water and a solution of 22.4 g of sodium chloride and 0.04 g of $K_4Fe(CN)_6.3H_2O$ in 285 ml of distilled water were added to and blended with the previous combined solution under the condition of 40° C. over a period of 5 minutes.

The emulsion thus obtained was observed with an electronic microscope to be composed of cubic grains having a mean edge length of about 0.21 μm and a fluctuation coefficient of grain size distribution of 9.8%.

The emulsion was de-salted, and 72 g of gelatin and 2.6 g of phenoxyethanol were added thereto. This was adjusted to have pH of 6.7 and pAg of 7.9 with NaCl, and then chemically sensitized at 58° C. in accordance with the process mentioned below. First, a monodispersed silver bromide emulsion having a mean grain size of 0.05 μm was added thereto in an amount of 1 mol % as silver halide, then 7.2 mg of the following Compound (1), 9.2 mg of chloroauric acid, 1.3 mg of triethylthiourea, 0.72 mg of the following Selenium Sensitizing Agent (A) and 0.29 g of nucleic acid and finally 162 mg of 4-hydroxy-6-methyl-1,3,3a,7-tetrazaindene were added thereto and rapidly cooled for solidification to obtain Emulsion A.

Compound (1):

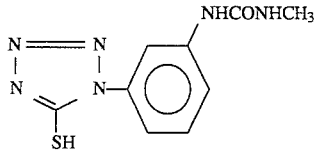

Selenium Sensitizing Agent (A):

-continued

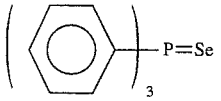

2. Preparation of Emulsion Coating Liquid

The following chemicals were added to the Emulsion A, the amounts thereof indicated below being per mol of silver halide, to prepare an emulsion coating liquid.

Formulation of Emulsion Coating Liquid

The Emulsion Coating Liquid was formulated as follows:

| | | |
|---|---|---|
| (a) | Spectral Sensitizing Dye (2) | $5.5 \times 10^{-5}$ mol |
| (b) | Supersensitizing Agent (3) | $3.3 \times 10^{-4}$ mol |
| (c) | Polyacrylamide (molecular weight: 40,000) | 9.2 g |
| (d) | Trimethylolpropane | 1.4 g |
| (e) | Poly(ethyl acrylate/methacrylic acid) Latex | 22 g |

Spectral Sensitizing Dye (2):

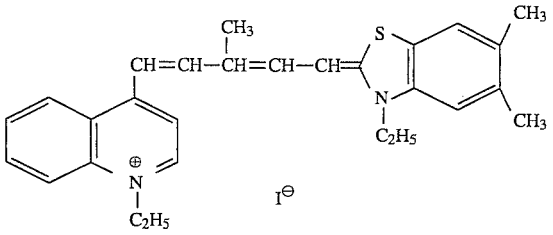

Supersensitizing Agent (3):

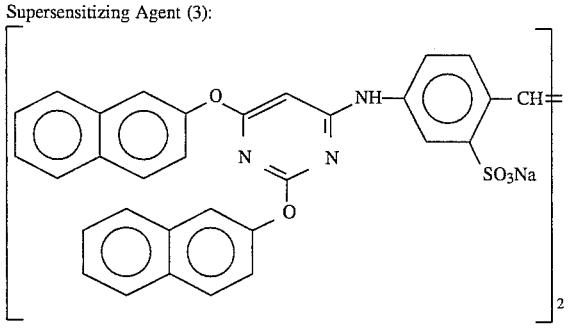

3. Preparation of Surface Protecting Layer Coating Liquid for Protecting Emulsion Layer A container was heated to 40° C., and the following chemicals were added thereto to prepare a coating liquid:

| | | |
|---|---|---|
| (a) | Gelatin | 100 g |
| (b) | Polyacrylamide (molecular weight 40,000) | 12.3 g |

-continued

| | | |
|---|---|---|
| (c) | Sodium Polystyrenesulfonate (molecular weight 600,000) | 0.6 g |
| (d) | Fine Grains of Polymethyl Methacrylate (mean grain size 2.5 μm) | 2.7 g |
| (e) | Sodium Polyacrylate | 3.7 g |
| (f) | Sodium t-octylphenoxyethoxyethanesulfonate | 1.5 g |
| (g) | $C_{16}H_{33}O-(CH_2CH_2O)_{10}-H$ | 3.3 g |
| (h) | $C_8F_{17}SO_3K$ | 84 mg |
| (i) | $C_8F_{17}SO_2N(C_3H_7)(CH_2CH_2O)_4(CH_2)_4-SO_3Na$ | 84 mg |
| (j) | NaOH | 0.2 g |
| (k) | Methanol | 78 cc |
| (l) | 1,2-Bis(vinylsulfonyl acetamido)ethane | to be 2.5% by weight to the total gelatin amount in the emulsion layer and the surface protecting layer |
| (m) | Compound (5) 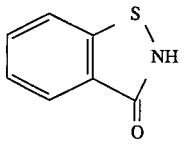 | 52 mg |

4. Preparation of Backing Layer Coating Liquid

A container was heated to 40° C., and the following chemicals were added thereto to prepare a backing layer coating liquid:

| | | |
|---|---|---|
| (a) | Gelatin | 100 g |
| (b) | Dye (A) 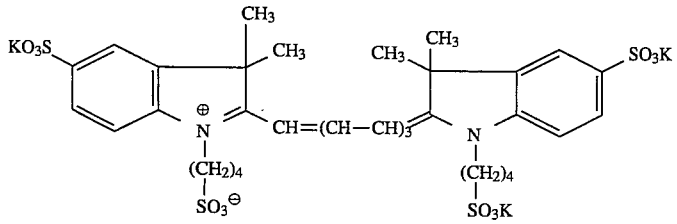 | 2.38 g |
| (c) | Sodium Polystyrenesulfonate | 1.1 g |
| (d) | Phosphoric Acid | 0.55 g |
| (e) | Poly(ethyl acrylate/methacrylic acid) Latex | 2.9 g |
| (f) | Compound (5) | 46 mg |
| (g) | Oil Dispersion of Dye (B) described in JP-A-61-285445 Dye (B): 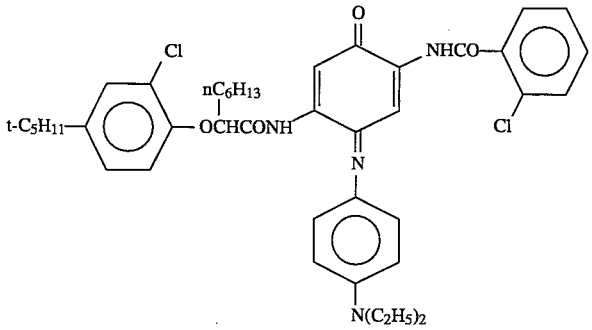 | 246 mg as dye itself |
| (h) | Oligomer Surfactant Dispersion of Dye (C) described in JP-A-62-275639 Dye (C): | 46 mg as dye itself |

-continued

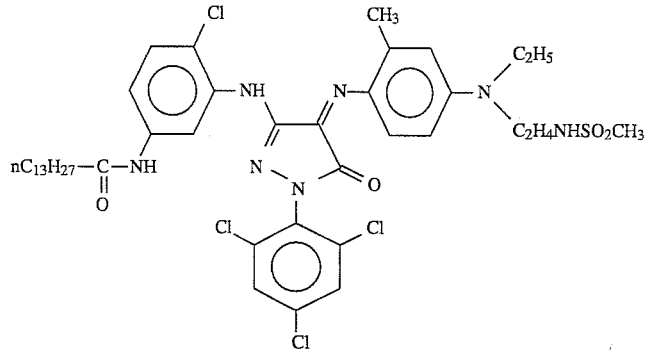

5. Preparation of Back Surface Protecting Layer Coating Liquid

A container was heated to 40° C., and the following chemicals were added thereto to prepare a coating liquid:

| | |
|---|---|
| (a) Gelatin | 100 g |
| (b) Sodium Polystyrenesulfonate | 0.3 g |
| (c) Fine Grains of Polymethyl Methacrylate (mean grain size 3.5 μm) | 4.3 g |
| (d) Sodium t-octylphenoxyethoxyethane-sulfonate | 1.8 g |
| (e) Sodium Polyacrylate | 1.7 g |
| (f) $C_{16}H_{33}O—(CH_2CH_2O)_{10}—H$ | 3.6 g |
| (g) $C_8F_{17}SO_3K$ | 268 mg |
| (h) $C_8F_{17}SO_2N(C_3H_7)(CH_2CH_2O)_4(CH_2)_4—SO_3Na$ | 45 mg |
| (i) NaOH | 0.3 g |
| (j) Methanol | 131 ml |
| (k) 1,2-Bis(vinylsulfonylacetamido)-ethane | to be 2.2% by weight to the total gelatin amount in the backing layer and surface protecting layer |
| (l) Compound (5) | 45 mg |

6. Formation of Photographic Material Sample

The above-mentioned backing layer coating liquid was coated on one surface of a blue-colored polyethylene terephthalate support along with the coating liquid for protecting the backing layer, the gelatin amount in the coated backing layer being 2.69 g/m$^2$ and the gelatin amount in the coated surface protecting layer being 1.13 g/m$^2$.

Next, the above-mentioned emulsion layer coating liquid and surface protecting layer coating liquid were coated on the opposite surface of the support, the coated silver amount being 1.85 g/m$^2$, the gelatin amount in the coated emulsion layer being 1.6 g/m$^2$, and the gelatin amount in the coated surface protecting layer being 1.23 g/m$^2$.

Thus, a photographic material sample was produced.

7. Frequency of Photographic Material Sample

The photographic material sample thus formed was processed, using one of the following developers:

| Developer A: | |
|---|---|
| Hydroquinone | 20.0 g |

-continued

| Developer A: | |
|---|---|
| 1-Phenyl-4-methyl-4-hydroxymethyl-3-pyrazolidone | 2.0 g |
| Sodium Sulfite | 35.0 g |
| Potassium Carbonate | 25.0 g |
| Diethylenetriamine-pentaacetic Acid | 2.0 g |
| Diethylene Glycol | 20.0 g |
| Boric Acid | 9.0 g |
| Potassium Bromide | 0.6 g (0.005 mol) |
| Water to make | one liter |
| Potassium Hydroxide to make | pH of 9.50 |

Developer B:

0.20 g of 5-methylbenzotriazole was added to one liter of Developer A.

Developer C:

0.15 g of 5-nitroindazole was added to one liter of Developer A.

Developer D:

0.10 g of 5-methylbenzotriazole, 0.10 g of 2-mercaptoimidazole-5-sulfonic acid and 0.10 g of 2,3,5,6,7,8-hexahydro-2-thioxo-4-(1H)-quinazoline were added to one liter of Developer A.

Developer E:

1.8 g of potassium bromide was added to one liter of Developer A.

Developer F:

Potassium hydroxide was added to one liter of Developer A to adjust its pH to 10.50.

RF-10 (produced by Fuji Photo Film Co., Ltd.) was used as a fixer. As the automatic processor, a modified FPM-2000 Model (manufactured by Fuji Photo Film Co., Ltd.) was used, in this processor, the driving shaft was reformed so that the conveying rate of a film to be processed therein from insertion of it into the machine to taking out of the processed film from the outlet of the drier was 45 seconds.

As a running test, 2 $m^2$/day of a film was processed with the processor every day for 3 weeks, with replenishing the developer being added in an amount of 260 ml (130 ml/$m^2$). The results obtained are shown below in Table 1. The sensitivity referred to in Table 1 indicates a relative value to the sensitivity of each sample film as processed with fresh Developer A, taken as 100, which is a reciprocal of the amount of exposure of giving an optical density of (fog+0.1). The fog indicates an optical density of the non-exposed area including the support.

As is obvious from the results in Table 1, the fog value of each sample film as processed in accordance with the method of the present invention using Developer A, B, C or D was low and the film as processed in accordance with the invention still had stable photographic properties even after 3 weeks at the same time, only the small amount of the replenisher of 130 ml per $m^2$ of film was applied to the processor every day. As opposed to this, the sensitivity of each film sample as processed with Developer E having a potassium bromide concentration of 0.02 mol/liter was low. Where each sample film was processed with Developer F, having pH of 10.50, the variation of the sensitivity between the case of using the fresh developer and the case of using the fatigued developer, after running tests for 3 weeks, was large, and the method of using Developer F was unstable.

TABLE 1

| | | Fresh Developer | | Fatigued Developer after Running Test for 3 Weeks | |
|---|---|---|---|---|---|
| | | Sensitivity | Fog | Sensitivity | Fog |
| Developer A | Example of the Invention | 100 | 0.18 | 100 | 0.18 |
| Developer B | Example of the Invention | 90 | 0.15 | 90 | 0.15 |
| Developer C | Example of the Invention | 90 | 0.15 | 90 | 0.15 |
| Developer D | Example of the Invention | 90 | 0.15 | 90 | 0.15 |
| Developer E | Comparative Example | 50 | 0.15 | 50 | 0.15 |
| Developer F | Comparative Example | 150 | 0.20 | 70 | 0.15 |

Hitherto, development of photographic materials with an automatic processor have been effected with a developer having pH of 10.50, such as Developer F, with replenishing 650 ml of a replenisher to the processor per $m^2$ of the material being processed for running operation of 3 weeks. In accordance with the method of the present invention, even a smal.1 amount of a replenisher of 130 ml per $m^2$ of a photographic material being processed is satisfactory for stable processing of the material for a long period of time with little variation of the photographic properties of the processed material. The progress of the present invention over the prior art is great.

While the invention has been described in detail and with reference to specific embodiments thereof, it will be apparent to one skilled in the art that various changes and modifications can be made therein without departing from the spirit and scope thereof.

What is claimed is:

1. A method of developing a transmissive black-and-white exposed silver halide photographic material with an automatic processor in which a developer is replenished with a predetermined amount of a replenisher in proportion to the area of the photographic material, comprising developing the material in a developer which contains a developing agent and which has a pH value of 9.8 or less, and wherein the developer which is being replenished has a bromide ion concentration of 0.01 mol/$^1$ or less and the rate of replenishment of said developer is 200 ml or less per $m^2$ of said material being processed, and the photographic material comprises a support having on one surface of the support a photographic silver halide emulsion layer comprising a silver halide emulsion containing 2.6 g/$m^2$ or less of silver and silver halide grains having a silver halide chloride content of 96 mol % or more.

2. The method as claimed in claim 1, wherein the rate of replenishment of said developer is 50 to 200 ml per $m^2$ of said material being processed.

3. The method as claimed in claim 1, wherein the pH value of the developer is from 8.5 to 9.8.

4. The method as claimed in claim 1, wherein the developer contains a benzotriazole derivative and/or a nitroindazole compound.

5. The method as claimed in claim 1, wherein the silver halide emulsion layer is spectrally-sensitized to be sensitive to rays of wavelength of 600 nm or more, said support is a transmissive support having a thickness of 150 μm or more, and the silver halide grains in said emulsion layer a) have a mean grain size of from 0.1 to 0.4 μm, b) have a (100) face to (111) face ratio of 5 or more in an amount of 50% by weight or more based on all of the silver halide grains contained in said emulsion layer, and c) have a composition selected from the group consisting of silver chlorobromide, silver chloroiodide, silver chloroiodobromide and silver chloride.

6. The method as claimed in claim 1, wherein the amount of silver in the silver halide emulsion is from 1.0 to 2.0 g/$m^2$.

7. The method as claimed in claim 5, wherein said grains in said emulsion have therein a localized silver bromide layer having a higher silver bromide content as compared with the base halide composition of the grain.

8. The method as claimed in claim 1, wherein the amount of silver in the silver halide emulsion is from 1.0 to 2.3 g/$m^2$.

9. The method as claimed in claim 1, wherein said silver halide grains comprise silver chloride having a mean silver chloride content of 96 mol % or more.

10. The method as claimed in claim 1, wherein the amount of silver in the silver halide emulsion is from 1.0 to 2.6 $g/m^2$.

11. The method as claimed in claim 1, wherein the developer has a pH value of 9.5 or less.

12. The method as claimed in claim 1, wherein the rate of replenishment of the developer is 130 ml or less per $m^2$ of the material being processed.

* * * * *

UNITED STATES PATENT AND TRADEMARK OFFICE

CERTIFICATE OF CORRECTION

PATENT NO. : 5,464,730
DATED : November 7, 1995
INVENTOR(S) : Eiichi OKUTSU et al.

It is certified that error(s) appears in the above-identified patent and that said Letters Patent is hereby corrected as shown below:

On title page, item [30], Foreign Application Priority Data, change

"4-492847" to --4-092847--.

Signed and Sealed this

Twenty-third Day of April, 1996

*Attest:*

Bruce Lehman

BRUCE LEHMAN

*Attesting Officer*

*Commissioner of Patents and Trademarks*